US008336988B2

(12) United States Patent
Watanabe

(10) Patent No.: US 8,336,988 B2
(45) Date of Patent: Dec. 25, 2012

(54) FLUID EJECTING APPARATUS

(75) Inventor: Eiichiro Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 305 days.

(21) Appl. No.: 12/786,161

(22) Filed: May 24, 2010

(65) Prior Publication Data

US 2010/0302310 A1 Dec. 2, 2010

(30) Foreign Application Priority Data

May 26, 2009 (JP) ..... 2009-126157

(51) Int. Cl.
*B41J 2/165* (2006.01)

(52) U.S. Cl. ..... 347/32; 347/29; 347/22; 347/30; 347/31

(58) Field of Classification Search ..... 347/32, 347/29, 22, 30, 31
See application file for complete search history.

(56) References Cited

U.S. PATENT DOCUMENTS 6,824,242 B1 11/2004 Silverbrook

FOREIGN PATENT DOCUMENTS

JP 2003-534165 T 11/2003
WO 01/89836 A1 11/2001

*Primary Examiner* — Matthew Luu
*Assistant Examiner* — Henok Legesse
(74) *Attorney, Agent, or Firm* — Workman Nydegger

(57) ABSTRACT

A fluid ejecting apparatus which ejects fluid from ejection nozzles provided on an ejection head includes a rotation body which is provided so as to be opposed to a nozzle face on which the ejection nozzles are formed and rotates about an rotation axis parallel with the nozzle face, a fluid reception portion which is provided on the rotation body at a surface opposed to the nozzle face and has a recess at which the fluid is received from the ejection nozzles, and a lid member which closes a lid on the recess by abutting against the fluid reception portion in conjunction with rotation of the rotation body when the rotation body rotates in the direction in which the fluid reception portion is separated from the position opposed to the nozzle face.

5 Claims, 7 Drawing Sheets

FLUID EJECTING APPARATUS

BACKGROUND

1. Technical Field

The present invention relates to a technique for ejecting fluid from an ejection head.

2. Related Art

A printer (so-called ink jet printer) which prints an image by discharging ink onto a print medium is capable of easily printing a high quality image. Therefore, the printer is widely used as an image output unit nowadays. It is considered that various types of precision parts such as an electrode, a sensor, a biochip can be easily manufactured by applying the technique as follows. That is, such precision parts can be manufactured by ejecting various types of fluids prepared to an appropriate component (the various types of fluids include liquid in which fine particulates of a functioning material are dispersed or semiliquid such as gel, for example) in place of ink onto a substrate.

In order to eject fluid properly, a dedicated ejection head on which fine ejection nozzles are provided is mounted on the ink jet printer or the fluid ejecting apparatus. A platen portion which supports a medium such as a printing paper is provided at a position opposed to the ejection head. Fluid is ejected from the ejection nozzles in a state where the medium is kept at an accurate position with the platen portion so that the fluid can be ejected onto the medium at an accurate position. When the characteristics of fluid have been changed because the fluid is dried in the ejection head, or in some case another trouble may happen in the ejection head, the fluid may not be ejected normally in some case. In order to deal with the problem, a cap which is connected to a suction pump is provided at a position different from that of the platen portion. Therefore, when the characteristics of the fluid in the ejection head have been changed, the ejection head is moved to the position of the cap from the position of the platen mechanism. Then, the cap is pressed against the ejection head so as to drive the suction pump. This makes it possible to suck the fluid of which characteristics have been changed from the ejection nozzles and discharge the fluid.

Further, when a large-sized ejection head is mounted on the fluid ejecting apparatus, it is difficult to move the ejection head from the position of the platen portion to that of the cap in some case. Then, a technique in order to deal with the problem is proposed (JP-T-2003-534165). In the technique, a platen portion and a cap are provided on surfaces of a rotation body provided so as to be opposed to the ejection head and the rotation body is rotated so that the platen portion and the cap can be easily switched without moving the ejection head.

However, in the proposed technique, there has been a problem that fluid in the cap is dried while the cap is not used. If the rotation body is rotated so as to switch the cap to the platen portion after the cap is used, inner portion of the cap is opened to the outside air. Therefore, a volatile component is volatilized from fluid adhered to the inner portion of the cap and the fluid is dried. This results in a disadvantage that the fluid is firmly fixed to the inner portion of the cap as to obstruct a suction flow path of the suction pump. It can be considered that the rotation body is rotated after fluid in the cap is completely discharged, as a matter of course. However, the fluid adhered to the inner portion of the cap cannot be completely discharged easily in fact.

SUMMARY

An advantage of some aspects of the invention is to provide a technique by which a problem that fluid in a cap provided on a rotation body is dried when the cap is rotated can be prevented from occurring.

According to an aspect of the invention, a fluid ejecting apparatus which ejects fluid from ejection nozzles provided on an ejection head includes a rotation body which is provided so as to be opposed to a nozzle face on which the ejection nozzles are formed and rotates about a rotation axis parallel with the nozzle face, a fluid reception portion which is provided on the rotation body at a surface opposed to the nozzle face and has a recess at which the fluid is received from the ejection nozzles, and a lid member which closes a lid on the recess by abutting against the fluid reception portion in conjunction with rotation of the rotation body when the rotation body rotates in the direction in which the fluid reception portion is separated from the position opposed to the nozzle face.

In the fluid ejecting apparatus according to the aspect of the invention, the rotation body is provided at a position opposed to the nozzle face on which the ejection nozzles are provided. Further, the fluid reception portion which receives fluid from the ejection nozzles is provided on the surface of the rotation body. If the rotation body is rotated and the fluid reception portion is moved away from the position opposed to the nozzle face, the lid member abuts against the fluid reception portion in conjunction with the rotation of the rotation body so as to close a lid on the fluid reception portion.

With this configuration, the lid member can close a lid on the fluid reception portion in conjunction with a movement in which the fluid reception portion is moved away from the position opposed to the nozzle face. Therefore, a problem that fluid in the fluid reception portion is dried while the fluid reception portion does not receive fluid can be prevented from occurring. Further, fluid in the fluid reception portion can be prevented from being dried only by rotating the rotation body and moving the fluid reception portion away from the position opposed to the nozzle face. Therefore, there is no need to additionally close a lid on the fluid reception portion. Accordingly, a configuration of the fluid ejecting apparatus in not complicated, thereby keeping the apparatus configuration to be simple.

It is to be noted that the fluid reception portion may have any configuration as long as the fluid reception portion is a mechanism for receiving fluid from the ejection nozzles. For example, the fluid reception portion may be a cap mechanism which sucks fluid from the ejection nozzles or may be a flushing reception mechanism which receives fluid ejected by the ejection nozzles.

In the fluid ejecting apparatus according to the above aspect of the invention, the lid member may be provided so as to project from the rotation body and an outer side member which abuts against the lid member when the rotation body is rotated may be provided. Then, the lid member may be abutted against the fluid reception portion by rotating the rotation body so as to make the lid member abut against the outer side member and turning the lid member with the outer side member.

By providing the lid member on the rotation body, the lid member rotates in conjunction with the rotation of the fluid reception portion when the fluid reception portion rotates in conjunction with the rotation of the rotation body. Accordingly, the lid member and the fluid reception portion are abutted against each other while the relative positions thereof with respect to the rotational direction of the rotation body are nearly unchanged. Therefore, a risk that the lid member or the fluid reception portion is moved in the rotational direction and is in friction contact with each other when the lid member and the fluid reception portion are abutted against each other can be eliminated. In addition, if the lid member is abutted against the outer side member so as to close a lid on the fluid reception portion, there is no need to provide a complicated mechanism for driving the lid member. Therefore, an apparatus configuration can be kept to be simple.

In the fluid ejecting apparatus according to the above aspect of the invention, the outer side member may be provided so as to surround the rotation body in the circumferential direction except a position opposed to the nozzle face.

With this configuration, fluid is not scattered to the outer side of the outer side member even if fluid adhered to the rotation body is scattered to the periphery along with the rotation of the rotation body. Therefore, a problem that scattered ink contaminates peripheral devices can be prevented from occurring.

Further, in the fluid ejecting apparatus according to the above aspect of the invention, the outer side member may bias the lid member in the direction of the fluid reception portion in a state where the lid member is abutted against the fluid reception portion. For example, it may be configured that the outer side member is formed of an elastic material so as to bias the lid member in the direction of the fluid reception portion with an elastic force when the lid member is abutted against the outer side member.

With this configuration, the lid member is pressed against the fluid reception portion so as to close a lid thereon more reliably. Therefore, fluid in the fluid reception portion can be prevented from being dried more reliably.

In the fluid ejecting apparatus according to the above aspect of the invention, a fluid-ejected medium supporting portion which supports a fluid-ejected medium for receiving fluid from the ejection nozzles may be provided on the rotation body. It may be configured such that if the rotation body is rotated so that the fluid-ejected medium supporting portion is opposed to the nozzle face, the lid member closes a lid on the fluid reception portion in conjunction therewith.

With this configuration, if the fluid-ejected medium supporting portion is opposed to the nozzle face in order to support the fluid-ejected medium at the time of ejecting fluid, the lid member closes a lid on the fluid reception portion in conjunction therewith. Therefore, a problem that fluid in the fluid reception portion is dried while fluid is ejected onto the fluid-ejected medium can be prevented from occurring.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention is described in the following order in order to make contents of the above-described invention clear.

Figure 1:
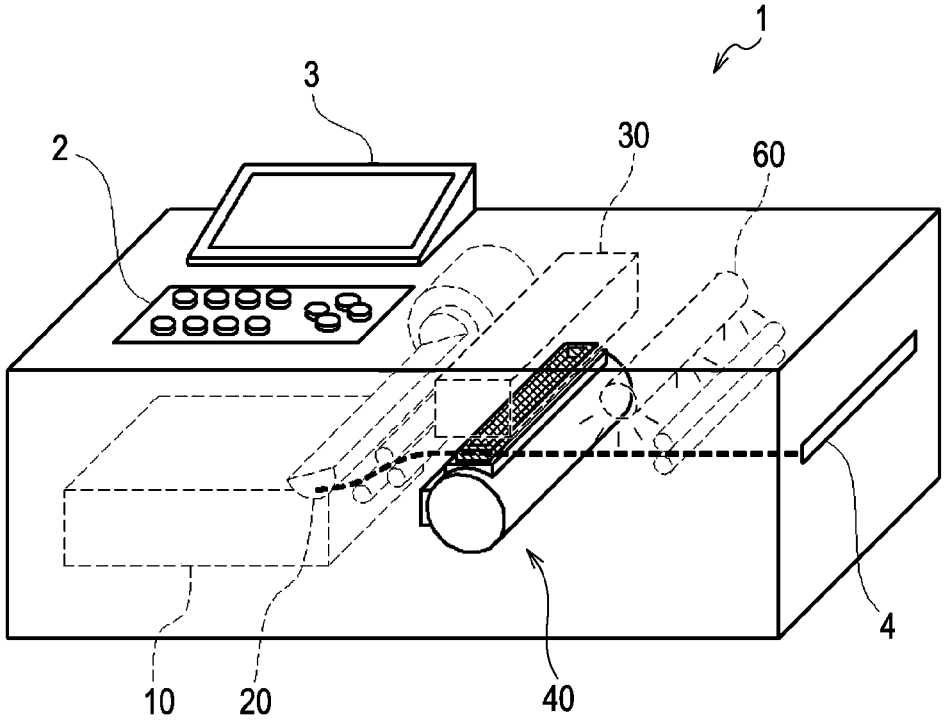
FIG. 1 is a descriptive view illustrating a configuration of a fluid ejecting apparatus according to an embodiment of the invention by exemplifying a so-called line head type ink jet printer.

A. Configuration of Fluid Ejecting Apparatus
B. Rotation Unit of the Embodiment
C. Modifications:
C-1. First Modification:
C-2. Second Modification:
C-3. Third Modification:
C-4. Fourth Modification:

A. Configuration of Fluid Ejecting Apparatus:

FIG. 1 is a descriptive view illustrating a configuration of the fluid ejecting apparatus according to an embodiment of the invention by exemplifying a so-called line head type ink jet printer. As shown in FIG. 1, an ink jet printer 1 has a roughly boxed-shape. An operation panel 2, a monitor screen 3 and the like by which a user operates the ink jet printer 1 are provided on an upper face of the ink jet printer 1. A sheet discharge port 4 for discharging a print medium on which an image has been printed is provided on a right side face.

A plurality of units or parts for executing various functions are mounted on the inside of the ink jet printer 1. At first, a head unit 30 which ejects ink onto a print medium is provided at a substantially center position of the ink jet printer 1. An ink cartridge storing ink is mounted on the inside of the head unit 30. Further, an ejection head on which fine ejection nozzles are provided is mounted on the bottom side (side opposed to the print medium) of the head unit 30. With this configuration, ink can be ejected from the ejection nozzles accurately by guiding ink stored in the ink cartridge to the ejection head.

A sheet feeding cassette 10 on which the print media are loaded is provided on a left side of the head unit 30 on a paper face in FIG. 1. The print medium on the sheet feeding cassette 10 is taken by a sheet feeding roller 20 so as to be transported to underneath of the head unit 30. When the print medium passes through the underneath of the head unit 30, ink is ejected from the ejection head of the head unit 30. Therefore, an image is printed on the print medium. In FIG. 1, a transportation path of the print medium is illustrated with a bold dashed line. The print medium on which the image has been printed in this manner is discharged from the sheet discharge port 4.

In the ink jet printer 1 according to the embodiment of the invention, a type of ink which is reactive to ultraviolet rays can be used. In correspondence to the type of ink, an ultraviolet lamp 60 which generates ultraviolet rays is provided on the right side of the head unit 30 (downstream side in the transportation direction of the print medium). When the type of ink which is reactive to ultraviolet rays is used, the ink is irradiated with ultraviolet rays generated by the ultraviolet lamp 60 after the ink is ejected from the head unit 30. This makes it possible to quickly dry the ink and fix the ink to the print medium by making the ejected ink react with the ultraviolet rays.

In such a manner, the ink jet printer 1 ejects ink from the ejection head provided on the bottom of the head unit 30 onto the print medium so as to print an image. As a matter of course, in order to print an image properly, a constant space is required to be kept between the print medium and the head unit 30. Therefore, the ink jet printer 1 includes a rotation unit 40 which is provided on the lower side of the head unit 30 and on which a flat surface which supports the print medium is formed. The flat surface formed on the rotation unit 40 is called a platen.

The rotation unit 40 has a substantially cylindrical shape, and is roughly long, as shown in FIG. 1. Further, the rotation unit 40 is provided so as to be opposed to the bottom of the head unit 30 while an axis of the rotation unit 40 is directed to the longitudinal direction of the head unit 30. In this case, the axis of the rotation unit 40 also has a substantially cylindrical shape. Although a detailed configuration of the rotation unit 40 will be described later, the rotation unit 40 includes a platen, a cap and the like. The platen supports a print medium from the back face side at the time of printing an image. The cap prevents ink from being dried by pressing the cap against the ejection head and sucks ink from the ejection head in a state where the cap is pressed against the ejection head. If the rotation unit 40 is rotated to direct the platen to the side of the ejection head, the rotation unit 40 can be functioned as a platen mechanism for supporting the print medium. On the other hand, if the cap is directed to the side of the ejection head, the rotation unit 40 can be functioned as a cap mechanism for preventing ink in the ejection head from being dried by pressing the cap against the ejection head and sucking ink from the ejection head.

By mounting the rotation unit 40 having such configuration, the ink jet printer 1 according to the embodiment of the invention can switch the platen mechanism and the cap mechanism easily. However, in the rotation unit, since inner portion of the cap is exposed to the outside air while the cap is not used, ink adhered to the inner portion of the cap tends to be dried. Accordingly, there is a risk causing a disadvantage that an absorbent in the cap is clogged due to the dried ink. Then, in the ink jet printer 1 according to the embodiment of the invention, the platen and the cap can be easily switched while a problem that ink in the cap is dried can be prevented from occurring by configuring the rotation unit 40 as follows.

Figure 2:
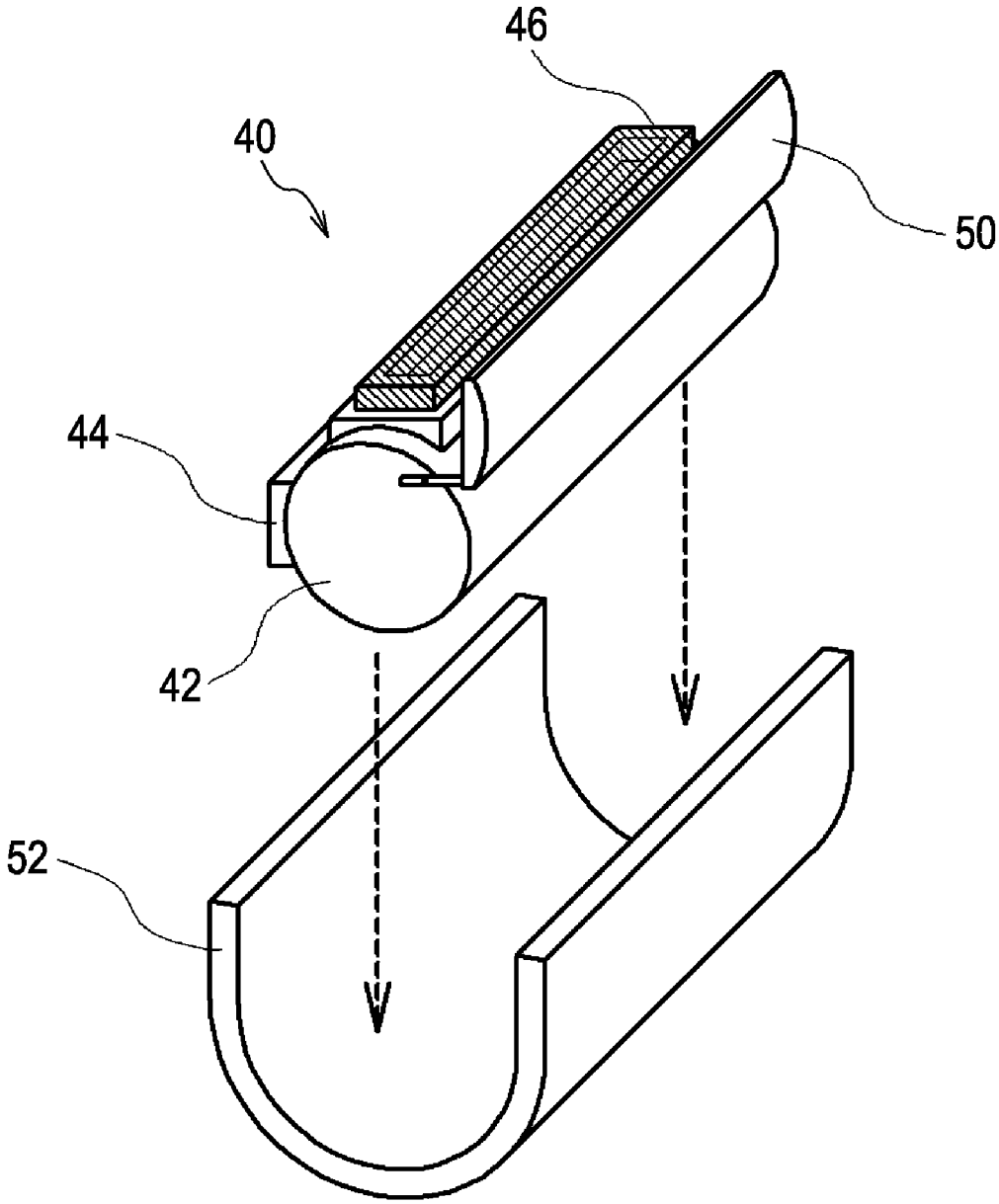
FIG. 2 is a descriptive view illustrating a rotation unit according to the embodiment of the invention.

B. Rotation Unit of the Embodiment:

FIG. 2 is a descriptive view illustrating a rotation unit according to the embodiment of the invention. As shown in FIG. 2, the rotation unit 40 includes a substantially cylindrical axial member 42, a platen 44 provided on a surface of the axial member 42, a cap 46, and the like. A driving motor (not shown) is connected to the axial member 42 to rotate the axial member 42 by driving the driving motor. Accordingly, a state where the platen 44 is used and a state where the cap 46 is used can be switched. In addition, a lid member 50 attached to an end face of the axial member 42 is provided on a side of the cap 46. The rotation unit 40 is mounted on the ink jet printer 1 in a state where the rotation unit 40 is accommodated in an outer circumferential member 52 having a substantially semi-cylindrical shape. With this configuration, in the rotation unit 40 according to the embodiment, ink in the cap 46 can be prevented from being dried while the cap 46 is not used. This point is described with reference to FIGS. 3A to 3C.

Figure 3A:
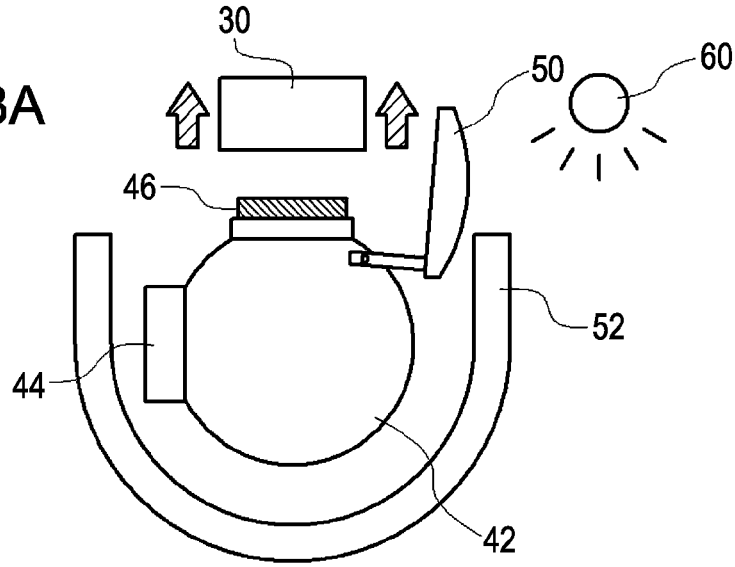
FIGS. 3A to 3C are descriptive views illustrating a process of switching a state where the rotation unit is used as a cap mechanism to a state where the rotation unit is used as a platen mechanism by rotating an axial member.
Figure 3B:
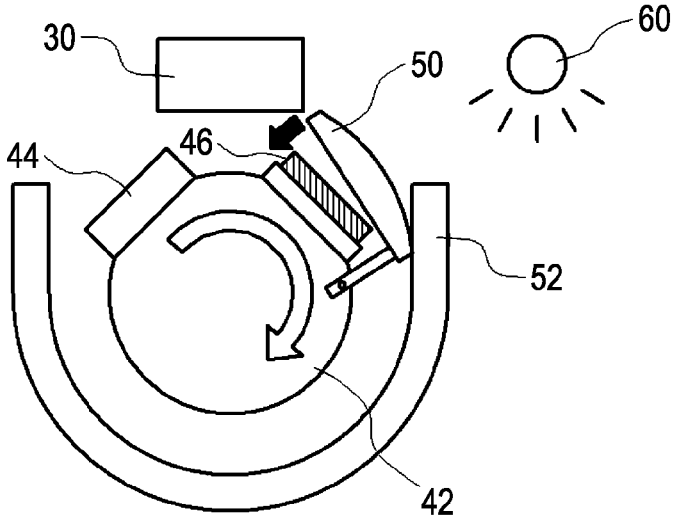
Figure 3C:
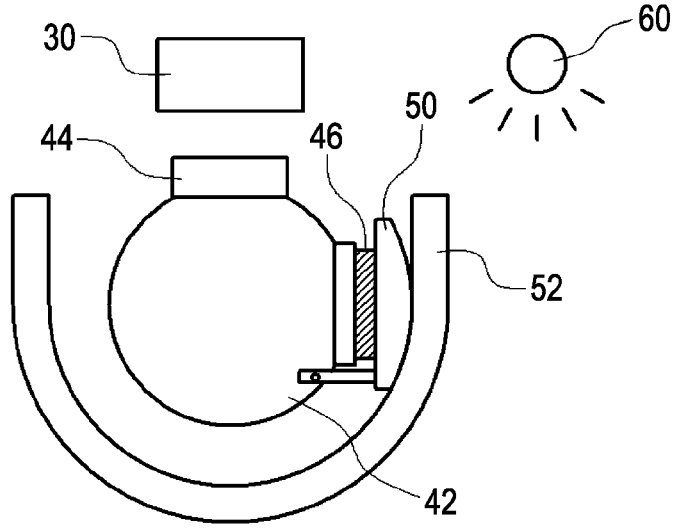

FIGS. 3A to 3C are descriptive views illustrating a process of switching a state where the rotation unit is used as the cap mechanism to a state where the rotation unit is used as the platen mechanism by rotating the axial member. As shown in FIG. 3A, the cap 46 is located under the head unit 30 in a state where the rotation unit 40 is used as the cap mechanism. The head unit 30 is pushed down by a cam mechanism (not shown) from this state to abut against the cap 46. When the cap mechanism is switched to the platen mechanism, at first, the cap 46 is separated from the bottom of the head unit 30 by pushing up the head unit 30 (see hatched arrows in FIG. 3A) by driving the cam mechanism. Subsequently, the driving motor is driven so as to rotate the axial member 42 as shown by a white arrow in FIG. 3B.

If the axial member 42 is rotated, the lid member 50 is also rotated in conjunction with the rotation of the axial member 42. Therefore, the lid member 50 abuts against the outer circumferential member 52, as shown in FIG. 3B. Then, if the axial member 42 is further rotated from this state, the lid member 50 is gradually pressed in the direction of the cap 46 with the outer circumferential member 52. Accordingly, the lid member 50 comes to cover the cap 46 as shown by a black arrow in FIG. 3B. Then, if the axial member 42 is further rotated from this state, the lid member 50 gradually covers the cap 46. With the rotation, when the platen 44 is positioned just under the head unit 30, the lid member 50 completely covers the cap 46 so as to seal the cap 46 with the lid member 50, as shown in FIG. 3C.

As described above, in the rotation unit 40 according to the embodiment of the invention, if the axial member 42 is rotated, the lid member 50 and the cap 46 come closer to each other in conjunction with the rotation of the axial member 42. Then, the lid member 50 and the cap 46 are abutted against each other so as to seal the cap 46. By sealing the cap 46 in such a manner, the inner portion of the cap 46 is never exposed to the outside air while the rotation unit 40 is used as a platen. Therefore, ink in the cap 46 can be prevented from being dried. As a result, a risk of causing disadvantages that due to the dried ink, the ink absorbent provided in the cap is clogged, or a suction flow path of the suction pump connected to the cap is obstructed can be avoided.

Further, in the rotation unit 40 according to the embodiment of the invention, the cap 46 and the lid member 50 are abutted against each other in conjunction with the rotation of the axial member 42 so as to seal the cap 46. Accordingly, the cap 46 can be sealed so as to reliably prevent ink in the cap 46 from being dried only by switching the rotation unit 40 from the cap 46 to another mechanism such as a platen. Since an operation for sealing the cap 46 needs not be additionally performed, a dedicated driving mechanism for driving the lid member 50 is not required to be additionally provided. This makes it possible to keep an apparatus configuration of the ink jet printer 1 simple.

Further, in the rotation unit 40 according to the embodiment of the invention, the cap 46 and the lid member 50 are abutted against each other by pressing the lid member 50 with the outer circumferential member 52. Accordingly, the lid member 50 can be pressed against the end face of the cap 46 in the substantially vertical direction, as shown by a black arrow in FIG. 3B. Therefore, the lid member 50 can be closely attached to the cap 46 reliably, thereby preventing ink in the cap 46 from being dried without fail.

When the rotation unit 40 is used as the cap mechanism again after the rotation unit 40 is switched to the platen mechanism, the axial member 42 is rotated in the reverse direction (reverse direction to the direction shown by the outline arrow in FIG. 3B) from the state shown in FIG. 3C. Then, the cap 46 is returned to a position opposed to the head unit 30. At this time, if the axial member 42 is rotated in the reverse direction, the lid member 50 is separated from the cap 46 with the weight of the lid member (see FIG. 3A) when the lid member 50 is separated from the outer circumferential member 52. Therefore, the lid member 50 can be detached from the cap 46 only by rotating the axial member 42 and returning the cap 46 to the position opposed to the head unit 30. As a matter of course, the lid member 50 may be detached from the cap 46 not with the weight of the lid member 50 but with an elastic force of a spring member by connecting the spring member or the like to the lid member 50. In both cases, since the lid member 50 is separated from the cap 46 when the lid member 50 is separated from the outer circumferential member 52, the lid member 50 can be easily detached from the cap 46 only by rotating the axial member 42 and moving the cap 46 to the position opposed to the head unit 30. Then, if the cam mechanism is driven to push down the head unit 30 in that state, the cap 46 is pressed against the head unit 30 so as to make the rotation unit 40 function as the cap mechanism again.

When other mechanisms than the cap such as the platen mechanism are used, the cap 46 is inclined as shown in FIG. 3C. However, since the cap 46 is sealed by the lid member 50, there is no risk that ink remaining in the cap 46 flows out even if the cap 46 is inclined. Therefore, the rotation unit 40 can be switched to the platen mechanism immediately after the cap mechanism is used without the need to wait until the ink in the cap 46 is completely discharged. Accordingly, in the ink jet printer 1 according to the embodiment of the invention, the rotation unit 40 can be switched to the platen mechanism immediately after the cap mechanism is used so that the printing of an image can be restarted quickly.

In addition, since ink in the cap 46 does not flows out even if the cap 46 is inclined, ink can be intentionally made remain in the cap 46. If ink is made remain in the cap 46, inner portion of the cap 46 can be kept to be moisturized by the volatile component of the remaining ink. Therefore, when the cap 46 is pressed against the head unit 30, a problem that the volatile component is volatilized into the cap 46 from ink in the head unit 30 and the characteristics of the ink in the head unit 30 are changed can be prevented from occurring.

Further, in the rotation unit 40 according to the embodiment of the invention, the outer circumferential member 52 is provided on the outer side of the rotation unit 40. Therefore, ink is never scattered to the outer side of the outer circumferential member 52 even if ink adhered to the axial member 42, the platen 44, or the like is scattered to the periphery along with the rotation of the axial member 42. Accordingly, a problem that scattered ink contaminates peripheral devices can be prevented from occurring.

Further, in the rotation unit 40 according to the embodiment of the invention, the lid member 50 is located between the ultraviolet lamp 60 and the cap 46 in a state where the cap 46 is directed to the head unit 30, as shown in FIG. 3A. Therefore, the inner portion of the cap 46 is not directly irradiated with ultraviolet rays from the ultraviolet lamp 60. This makes it possible to avoid a disadvantage that ink in the cap 46 is reacted with ultraviolet rays and solidified while the cap 46 is used. In addition, the lid member 50 is positioned between the cap 46 and the ultraviolet lamp 60 not only while the cap 46 is directed to the head unit 30 but while the cap 46 and the platen 44 are switched (see, FIG. 3B). Therefore, the inner portion of the cap 46 is not irradiated with ultraviolet rays in the period when the cap 46 and the platen 44 are switched. This eliminates the need to turn off the ultraviolet lamp 60 while the cap 46 is used or while the cap 46 and the platen 44 are switched, thereby making a control circuit of the ultraviolet lamp 60 simple. Moreover, since the ultraviolet lamp 60 needs not be turned off, there is no need to wait until the ultraviolet lamp 60 is turned on and a light intensity of the ultraviolet lamp 60 becomes stable when the printing is restarted by switching to the platen 44. This enables the printing to be restarted quickly. Further, since the ultraviolet lamp 60 needs not be frequently turned on or turned off, the lifetime of the ultraviolet lamp 60 can be made longer.

Although the rotation unit 40 as shown in FIGS. 3A to 3C has a configuration in which the lid member 50 is rotated in conjunction with the rotation of the axial member 42, the rotation unit 40 may have a configuration in which the lid member 50 is not rotated. For example, the rotation unit 40 may have a configuration in which the lid member 50 is fixed to the inner side of the outer circumferential member 52 so as not to rotate the lid member 50. In this case, as the axial member 42 rotates, the cap 46 is rotated to come closer to the lid member 50. Then, the cap 46 and the lid member 50 are abutted against each other so as to seal the cap 46. That is to say, the cap 46 can be sealed only by rotating the axial member 42. Further, if the rotation unit 40 has a configuration in which the lid member 50 is fixed to the inner side of the outer circumferential member 52, a bearing for making the lid member 50 movable can be eliminated. This makes it possible to make the configuration of the rotation unit 40 more simple. With respect to the configuration, if the rotation unit 40 has a configuration in which the lid member 50 is rotated in conjunction with the axial member 42 as shown in FIGS. 3A to 3C, the following advantages can be obtained as described above. That is, the inner portion of the cap 46 can be prevented from being irradiated with ultraviolet rays from the ultraviolet lamp 60 with the lid member 50. Further, the cap 46 can be reliably sealed by pressing the lid member 50 against the end face of the cap 46 from the vertical direction.

C. Modifications:

C-1. First Modification:

In the rotation unit 40 according to the above embodiment of the invention, the cap 46 is sealed with the lid member 50. However, not only the cap 46 but a so-called flushing reception portion can be sealed.

Figure 4A:
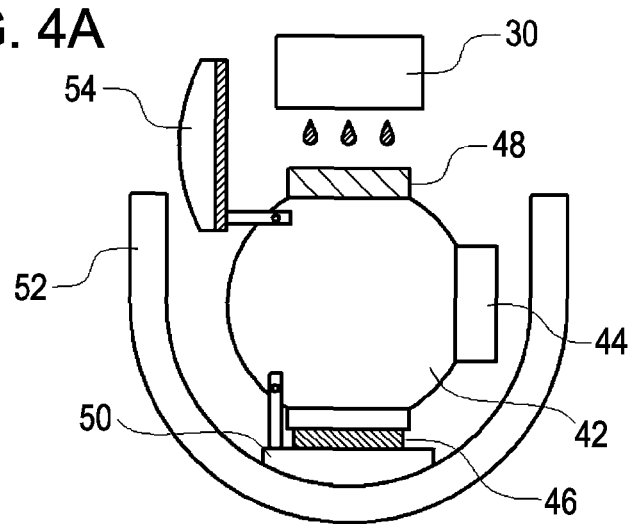
FIGS. 4A to 4C are descriptive views illustrating a rotation unit in which both a cap and a flushing reception portion are capable of being sealed according to a first modification.
Figure 4B:
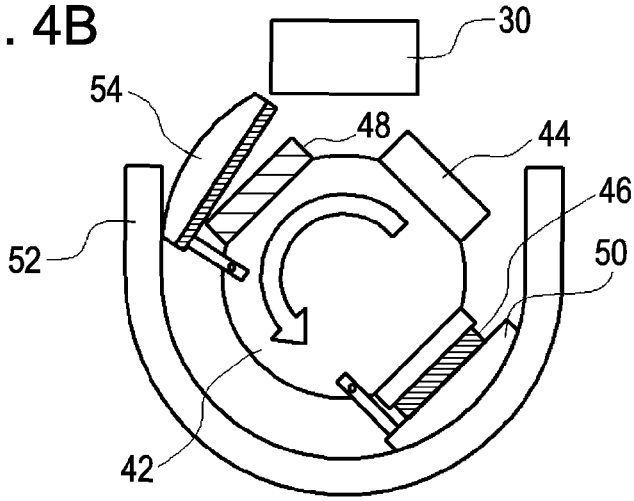
Figure 4C:
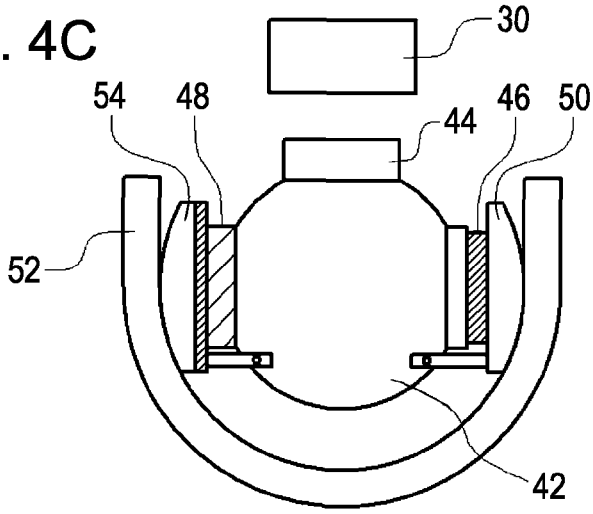

FIGS. 4A to 4C are descriptive views illustrating a rotation unit in which both the cap and the flushing reception portion are capable of being sealed according to the first modification. As shown in FIG. 4A, in the rotation unit 40 according to the first modification, a flushing reception portion 48 is provided on a surface of the axial member 42. Ink of which characteristics have been changed in the head unit 30 can be discharged from the ejection head by performing an operation of ejecting ink from the ejection head of the head unit 30 onto the flushing reception portion 48 (flushing operation). An absorbent for absorbing ink discharged by the flushing operation is provided in the flushing reception portion 48. Further, a discharge tube for discharging ink is connected to the bottom of the flushing reception portion. However, the absorbent and the discharge tube are not illustrated in FIGS. 4A to 4C so as not to make the drawings complex.

As shown in FIG. 4A, a lid member 54 for the flushing reception portion is provided on the side of the flushing reception portion 48. A seal member made of a rubber is attached to the inner side (see hatched portion in FIG. 4A) of the lid member 54 for the flushing reception portion. If the axial member 42 is rotated after the flushing operation is performed, as shown in FIG. 4B, the lid member 54 is pressed by the outer circumferential member 52 so as to come closer to the flushing reception portion 48 and the seal member of the lid member 54 covers the flushing reception portion 48. Then, if the axial member 42 is rotated until the platen 44 moves to a position opposed to the head unit 30, the seal member of the lid member 54 is closely attached to the flushing reception portion 48 so as to seal the flushing reception portion 48.

By providing the lid member 54 on the side of the flushing reception portion 48 as described above, when the flushing reception portion is switched to the platen mechanism or the like, the flushing reception portion 48 is sealed so that ink in the flushing reception portion can be prevented from being dried. Therefore, a risk of causing a disadvantage that the ink absorbent in the flushing reception portion is clogged due to the dried ink, can be avoided. Further, in a state where the platen 44 is moved to the position opposed to the head unit 30 as shown in FIG. 4C, both the flushing reception portion 48 and the cap 46 are sealed. Therefore, ink in both the flushing reception portion 48 and the cap 46 can be prevented from being dried while the platen 44 is used.

As shown in FIG. 4A, the cap 46 is sealed while the flushing operation is performed. Therefore, ink in the cap can be prevented from being dried not only while the platen 44 is used but while the flushing operation is performed.

When the flushing operation is performed again by switching the rotation unit 40, the axial member 42 may be rotated in the direction opposite to the direction shown by an outline arrow in FIG. 4B to move the flushing reception portion 48 to a position opposed to the head unit 30. In such a manner, the lid member 54 is separated from the flushing reception portion 48 when the lid member 54 is separated from the outer circumferential member 52 as in the case of the lid member 50 of the cap 46 as described above (see FIG. 3). Therefore, the lid member 54 can be detached only by rotating the axial member 42.

C-2. Second Modification:

As described above, the outer circumferential member 52 has a function of abutting the lid members 50, 54 against the cap 46 or the flushing reception portion 48. Therefore, the outer circumferential member 52 may be formed of an elastic material.

Figure 5A:
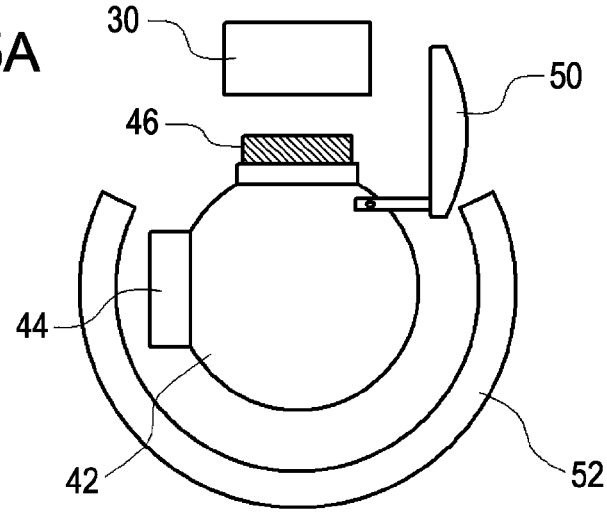
FIGS. 5A to 5C are descriptive views illustrating a rotation unit in which an outer circumferential member is formed of an elastic material according to a second modification.
Figure 5B:
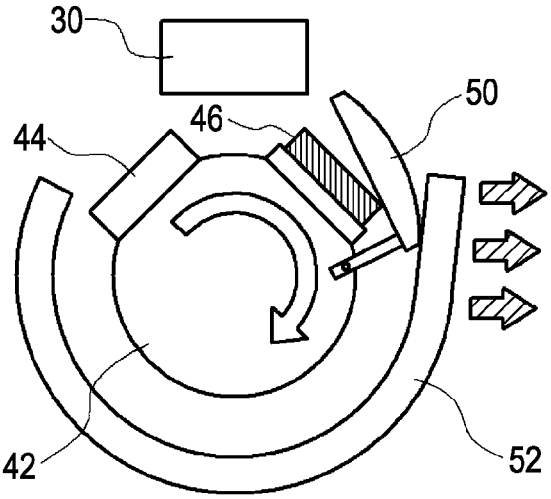
Figure 5C:
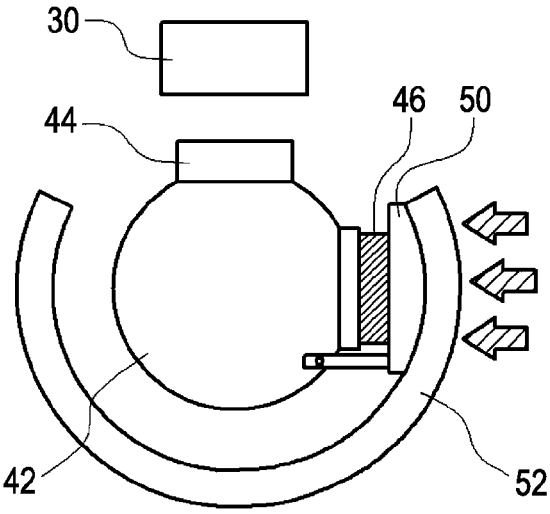

FIGS. 5A to 5C are descriptive views illustrating a rotation unit in which the outer circumferential member 52 is formed of an elastic material. As shown in FIG. 5A, in the rotation unit 40 according to the second modification, the outer circumferential member 52 is provided on a position surrounding the axial member 42. Here, the outer circumferential member 52 is formed of an elastic member in the rotation unit 40 according to the second modification.

As the lid member 50 and the outer circumferential member 52 are abutted against each other by rotating the axial member 42, the lid member 50 moves to the inside of the outer circumferential member 52 as shown in FIG. 5B. At the same time, the outer circumferential member 52 is pressed by the lid member 50 and is elastically deformed outward. Then, when the axial member 42 is further rotated and the lid member 50 covers the cap 46, the outer circumferential member 52 tries to return to an original shape with the elastic force in turn so that the outer circumferential member 52 presses the lid member 50 inward from the outside, as shown in FIG. 5C. With this configuration, the lid member 50 is pressed against the cap 46 so that the cap is sealed. In such a manner, in the rotation unit according to the second modification, the lid member 50 and the cap 46 can be closely attached to each other reliably by biasing the lid member 50 by the outer circumferential member 52. As a result, the cap 46 can be sealed more reliably.

It is to be noted that not the lid member 50 but the cap 46 may be biased. For example, an elastic member is provided between the cap 46 and the axial member 42. Then, the cap 46 may be pressed against the lid member 50 from the side of the axial member 42 with the elastic force of an elastic member. In this case, the cap 46 and the lid member 50 can be also closely attached to each other, thereby sealing the cap 46 reliably.

C-3. Third Modification:

Further, the lid member may be biased by a force of rotating the rotation unit so as to be closely attached to the cap in the following way. That is to say, the lid member may be biased not by forming the outer circumferential member with the elastic member but by forming the outer circumferential member having a shape in which an inner diameter is gradually decreased.

Figure 6A:
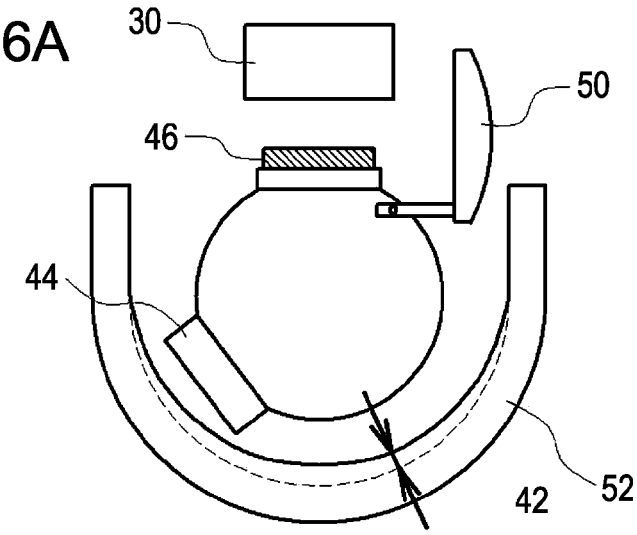
FIGS. 6A to 6C are descriptive views illustrating a rotation unit in which a lid member is biased with an outer circumferential member having a shape in which an inner diameter is gradually decreased according to a third modification.
Figure 6B:
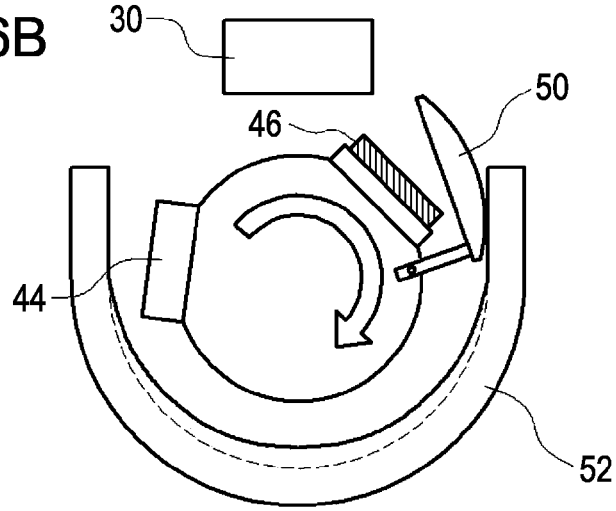
Figure 6C:
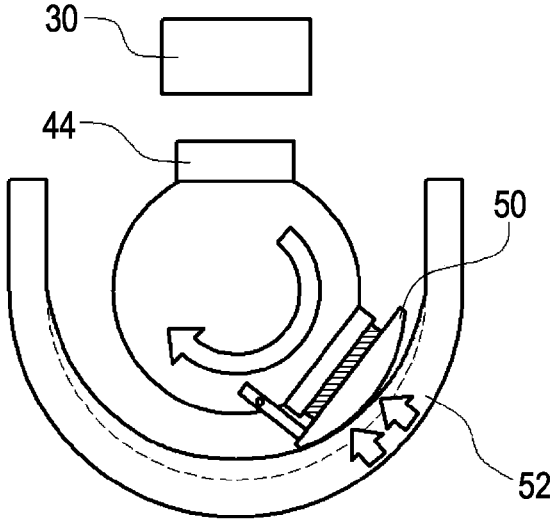

FIGS. 6A to 6C are descriptive views illustrating a rotation unit in which a lid member is biased with the outer circumferential member having a shape in which the inner diameter is gradually decreased according to a third modification. In FIG. 6A, a position of the outer circumferential member when the inner diameter of the outer circumferential member 52 is formed to be constant is illustrated by a dashed line. On the other hand, in the rotation unit 40 according to the third modification, the outer circumferential member 52 is formed such that the inner diameter of the outer circumferential member 52 is gradually decreased toward the bottom thereof, as shown by arrows in FIG. 6A.

As shown in FIG. 6B, if the axial member 42 is rotated, the lid member 50 is pressed by the outer circumferential member 52 so as to seal the cap 46 as in the case of the rotation unit 40 according to the above embodiment. At this time, since the inner diameter of the outer circumferential member 52 is gradually decreased toward the bottom of the outer circumferential member 52. Therefore, if the lid member 50 is moved toward the bottom of the outer circumferential member 52 by rotating the axial member 42, the lid member 50 is pressed by the outer circumferential member 52 inward. Accordingly, the lid member 50 is pressed against the cap 46. With this configuration, the lid member 50 can be closely attached to the cap 46 reliably so as to seal the cap 46. Further, since the inner diameter of the outer circumferential member 52 is gradually decreased toward the bottom thereof, the lid member 50 can be pressed against the cap 46 strongly as the axial member 42 is rotated. As described above, in the rotation unit 40 according to the third modification, the lid member 50 can be biased by a force of the driving motor for rotating the axial member 42. As a result, the lid member 50 can be closely attached to the cap 46 so as to reliably seal the cap 46.

C-4. Fourth Modification:

Further, if an angle of the lid member 50 with respect to the cap 46 can be changed, the lid member 50 and the cap 46 can be closely attached to each other more reliably.

Figure 7A:
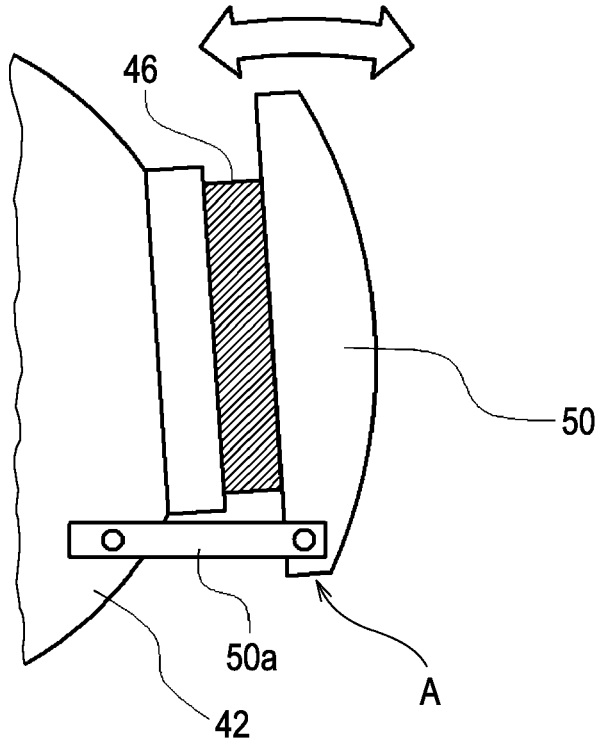
FIGS. 7A and 7B are descriptive views illustrating a rotation unit in which an angle of the lid member can be changed with respect to an end face of the cap according to a fourth modification.
Figure 7B:
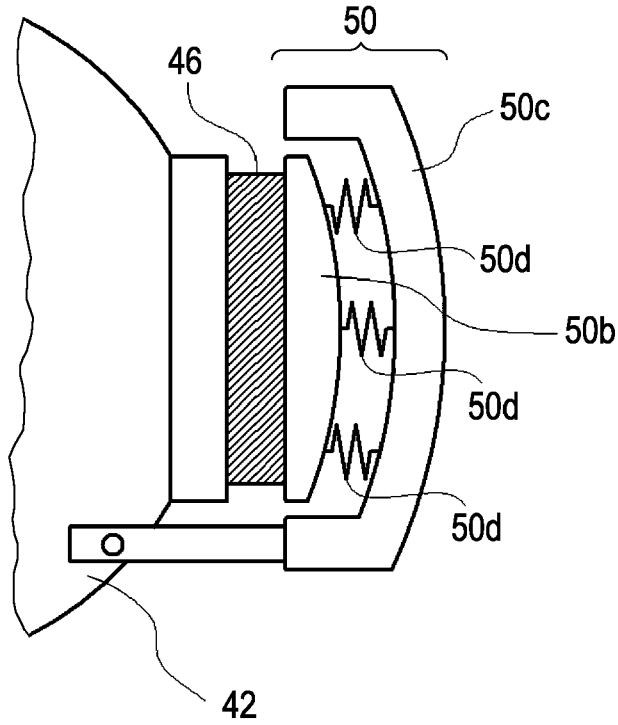

FIGS. 7A and 7B are descriptive views illustrating a rotation unit 40 in which an angle of the lid member with respect to the end face of the cap can be changed according to a fourth modification. As shown in FIG. 7A, in the rotation unit 40 according to the fourth modification, the lid member 50 is axially supported by a connection arm 50*a* connected to the axial member 42 (see a portion "A" in FIG. 7A). The lid member 50 is rotatable about the bearing portion as shown by a white arrow in FIG. 7A. With this configuration, even if the cap 46 and the lid member 50 are abutted to each other obliquely due to an assembling error at the time of assembling the cap 46 and the lid member 50, the lid member 50 can be closely attached to the cap 46 by rotating the lid member 50. Therefore, the cap 46 can be sealed more reliably.

Further, as shown in FIG. 7B, the lid member 50 may be provided such that the lid member 50 is divided into an inner side member 50*b* and an outer side member 50*c*. Note that the inner side member 50*b* abuts against the cap 46 and the outer side member 50*c* supports the inner side member 50*b* through an elastic member 50*d*. In this case, the inner side member 50*b* is pressed against the cap 46 by the elastic member 50*d* and freely rotates in correspondence to the inclination of an end face of the cap 46 so that the inner side member 50*b* is closely attached to the end face of the cap 46. Therefore, the cap 46 can be sealed more reliably.

Hereinbefore, the fluid ejecting apparatus according to the embodiment is described by exemplifying the ink jet printer. However, the invention is not limited to the above-described embodiment and modifications. The invention can be implemented in various modes in a range without departing from a scope of the invention. For example, although the ink jet printer in which ink is ejected in a state where the ejection head is fixed (so-called line head type ink jet printer) is described as an example in the above embodiment and modifications, the ink jet printer may be an ink jet printer having a configuration in which ink is ejected while being reciprocated (so-called serial type ink jet printer). In such a case, by using the rotation unit according to the above embodiment, the cap and the platen can be switched quickly and the cap can be reliably sealed. Therefore, ink in the cap can be prevented from being dried.

The entire disclosure of Japanese Patent Application No. 2009-126157, filed May 26, 2009 is expressly incorporated by reference herein.

What is claimed is:

1. A fluid ejecting apparatus which ejects fluid from ejection nozzles provided on an ejection head, comprising:

a rotation body which is provided so as to be opposed to a nozzle face on which the ejection nozzles are formed and rotates about a rotation axis parallel with the nozzle face;

a fluid reception portion which is provided on the rotation body at a surface opposed to the nozzle face and has a recess at which the fluid is received from the ejection nozzles; and a lid member which closes a lid on the recess by abutting against the fluid reception portion in conjunction with rotation of the rotation body when the rotation body rotates in the direction in which the fluid reception portion is separated from the position opposed to the nozzle face.

2. The fluid ejecting apparatus according to claim 1, wherein the lid member is provided so as to project from the rotation body, and the apparatus further includes an outer side member which makes the lid member abut against the fluid reception member by abutting against the lid member provided so as to project from the rotation body and turning the lid member when the rotation body rotates in the direction in which the fluid reception portion is separated from the position opposed to the nozzle face.

3. The fluid ejecting apparatus according to claim 1, wherein a fluid-ejected medium supporting portion which supports a fluid-ejected medium for receiving fluid from the ejection head from a backside of the fluid-ejected medium is provided on the surface of the rotation body, and the lid member is a member which abuts against the fluid reception portion when the rotation body is rotated until the fluid-ejected medium supporting portion and the nozzle face are opposed to each other.

4. The fluid ejecting apparatus according to claim 2, wherein the outer side member is a member provided so as to cover the rotation body in the circumferential direction except a portion opposed to the nozzle face.

5. The fluid ejecting apparatus according to claim 2, wherein the outer side member is a member which biases the lid member against the fluid reception portion in a state where the lid member abuts against the fluid reception portion.

* * * * *